US006446413B1

(12) United States Patent
Gruber

(10) Patent No.: US 6,446,413 B1
(45) Date of Patent: Sep. 10, 2002

(54) PORTABLE GRAPHIC FLOOR SYSTEM

(75) Inventor: Moritz F. Gruber, Huntingdon (CA)

(73) Assignee: Folia Industries Inc., Huntingdon ( * ) Notice: Subject to any disclaimer, the term of this patent is extended or adjusted under 35 U.S.C. 154(b) by 0 days.

(21) Appl. No.: 09/779,494

(22) Filed: Feb. 9, 2001

(30) Foreign Application Priority Data

Jan. 22, 2001 (CA) ..... 2331800

(51) Int. Cl.[7] ..... E04F 15/02

(52) U.S. Cl. ..... 52/747.11; 52/177; 52/127.7; 52/586.2

(58) Field of Search ..... 52/177, 127.7, 52/127.8, 127.11, 390, 586.1, 586.2, 592.1, 591.1, 589.1, 747.11, 126.6

(56) References Cited

U.S. PATENT DOCUMENTS 1,778,352 A * 10/1930 Bruce ..... 52/390
4,638,604 A * 1/1987 Rogers et al. ..... 52/126.6 X
4,843,792 A * 7/1989 Rogers et al. ..... 42/127.7
5,070,662 A * 12/1991 Niese ..... 52/127.7
5,117,596 A * 6/1992 Leslie et al. ..... 52/126.6
5,205,087 A * 4/1993 Jines ..... 52/586.1 X
5,634,309 A * 6/1997 Polen ..... 52/592.1 X
6,189,283 B1 * 2/2001 Bentley et al. ..... 52/47.11 X

* cited by examiner

*Primary Examiner*—Laura A. Callo
(74) *Attorney, Agent, or Firm*—Swabey Ogilvy Renault; Guy J. Houle

(57) ABSTRACT

A panel for a portable floor system comprising a rectangular core defining an upper surface and a lower surface extending parallel to the upper surface and lateral side surfaces extending from edges of the upper surface to edges of the lower surface. Frame members are connected to the lateral side surfaces and define outwardly projecting channels. The frame members have opposed spaced parallel horizontal walls defining an upper wall and a lower wall, and further have a transverse connecting end wall for connection to the lateral side surfaces. A laminated graphic layer is integrally joined to the upper surface of the rectangular core and extends over the upper walls of the frame members to conceal the frame members. The channels of the frame members have flanges for releasably securing connecting members for joining a panel to other panels in side-by-side aligned relationship.

1 Claim, 3 Drawing Sheets

PORTABLE GRAPHIC FLOOR SYSTEM

FIELD OF THE INVENTION

The present invention relates to portable floor systems for mounting on floors, and more particularly but not exclusively to a portable floor system constructed of interlocking panels and displaying a graphic surface on a top face thereof.

BACKGROUND OF THE INVENTION

Portable floor systems are known in the art and are employing interlocking panels mounted on an existing floor surface. Portable floor systems serve many purposes. For instance, a portable floor system may be used as a permanent or temporary dance floor, in order to protect the existing floor surface from the wear inherent to a dance floor. Portable floor systems have also been known to embellish or display a specific design on existing floor surfaces.

U.S. Pat. No. 5,634,309, issued on Jun. 3, 1997 to Polen discloses a portable dance floor in which a plurality of identical square sections are assembled. The square sections are held together magnetically and are aligned by male/female couplers. Ramp members are attachable to the outer perimeter of the assembled square sections.

U.S. Pat. No. 6,006,486, issued on Dec. 28, 1999 to Moriau et al. introduces a floor panel with edge connectors for a portable floor system. In this case, edges of two opposite sides of a panel are provided with coupling parts cooperating with each other. The coupling parts are substantially in the form of a tongue and a groove and are provided with integrated mechanical locking elements which prevent the drifting apart of joined floor panels. The coupling parts form a fixed part of the floor panels. This Patent further discloses a method for milling the above mentioned coupling parts of the floor panels.

The above mentioned portable floor systems have many advantages. For instance, they can be installed with ease as no tools nor mechanical fasteners, such as screws, nails or the like are required. U.S. Pat. No. 5,634,309 is advantageous in providing coupling means for all lateral side surfaces of the panels. From a top plan view, the panels of this patent are coupled in both the X and the Y axis directions. This feature ensures the integrity of the assembly.

U.S. Pat. No. 6,006,486 discloses permanent floor covering made of panels that interconnect in snap-fit interlocking engagement by machine configured tongues and grooves. This provides increased resistance to prevent the drifting apart of two coupled panels in a direction perpendicular to the related edges of the coupled panels, in comparison with the magnetic forces previously disclosed. Another advantage resides in the fact that adjacent panels need not be slid one into the other to be coupled. The tongue coupling part of a panel may slightly be inserted in a groove coupling part from above an adjacent panel, to then be pressed down for full cooperating engagement with the groove coupling part. The assembly of panels is thus more easily achieved and accelerated.

It would be desirable to provide a portable floor system which includes the advantages described above in addition to providing several other advantages, such as being economical to manufacture, providing durable precision graphics, lightweight, easy to expand, easy to repair, and which can be transported and stored in a limited amount of space.

DISCLOSURE OF THE INVENTION

It is a feature of the present invention to provide a portable graphic floor system having panels interlocked in perpendicular directions with simple interconnecting members and providing the abovementioned desirable feature.

SUMMARY OF THE INVENTION

According to the above aim of the present invention, from a broad aspect, the present invention provides a panel for a portable floor system comprising a rectangular core defining an upper surface and a lower surface extending parallel to the upper surface and lateral side surfaces extending from edges of the upper surface to edges of the lower surface. Frame members are connected to the lateral side surfaces and define outwardly projecting channels. Each of the frame members have opposed spaced parallel horizontal walls defining an upper wall and a lower wall, and further have a transverse connecting end wall for connection to the lateral side surfaces. A top layer is integrally joined to the upper surface of the rectangular core and extends over the upper walls of the frame members to conceal the frame members. The channels of the frame members have retention means for releasably securing at least one connecting member for joining the panel to another one of the panel in side-by-side aligned relationship.

According to a further broad aspect of the present invention there is provided a portable floor system adapted to be mounted on a floor and comprising a plurality of panels defining a floor surface. Each of the panels has a rectangular core defining an upper surface and a lower surface extending parallel to the upper surface and lateral side surfaces extending from edges of the upper surface to edges of the lower surface. Frame members are connected to the lateral side surfaces and define outwardly projecting channels. Each of the frame members have opposed spaced parallel horizontal walls defining an upper wall and a lower wall, and further have a transverse connecting end wall for connection to the lateral side surfaces. A top layer is integrally joined to the upper surface of the rectangular core and extends over the upper walls of the frame members to conceal the frame members. The channels of the frame members have retention means for releasably securing connecting members for joining at least two of the panels to adjacent lateral side surfaces of one of the panels in side-by-side aligned relationship.

According to a still further broad aspect of the present invention there is provided a method for assembly of a portable floor system on a floor surface to provide a temporary floor of an outer perimeter of predetermined dimension. The method comprises the steps of:

(i) inserting a free end portion of a channel of an inclined second panel to a connecting member releasably secured within a channel of a first panel lying flat on a floor surface;

(ii) downwardly hinging the second panel to an assembled position with the first panel, wherein the first panel and the second panel are connected together, co-planar and in side-by-side relationship;

(iii) slidably inserting an identical one of the connecting member in opposed adjacent channels of a third panel assembled to the first panel and a fourth panel assembled to the second panel, thereby assembling the third panel to the fourth panel;

(iv) continuing assembling further panels according to steps (i), (ii), and (iii) until the floor of predetermined dimension is complete;

(v) inserting a connecting portion of an inclined end connecting member to the free ends of at least two of the channels to overlap at least two of the panels defining the outer perimeter;

(vi) downwardly hinging the end connecting member to an assembled position with the at least two of the panels;

(vii) continuing assembling further end connecting members according to steps (v) and (vi) to immovably interlock all of the panels together.

BRIEF DESCRIPTION OF THE DRAWINGS

A preferred embodiment of the present invention will now be described in detail having reference to the accompanying drawings in which.

DESCRIPTION OF THE PREFERRED EMBODIMENT

Figure 1:
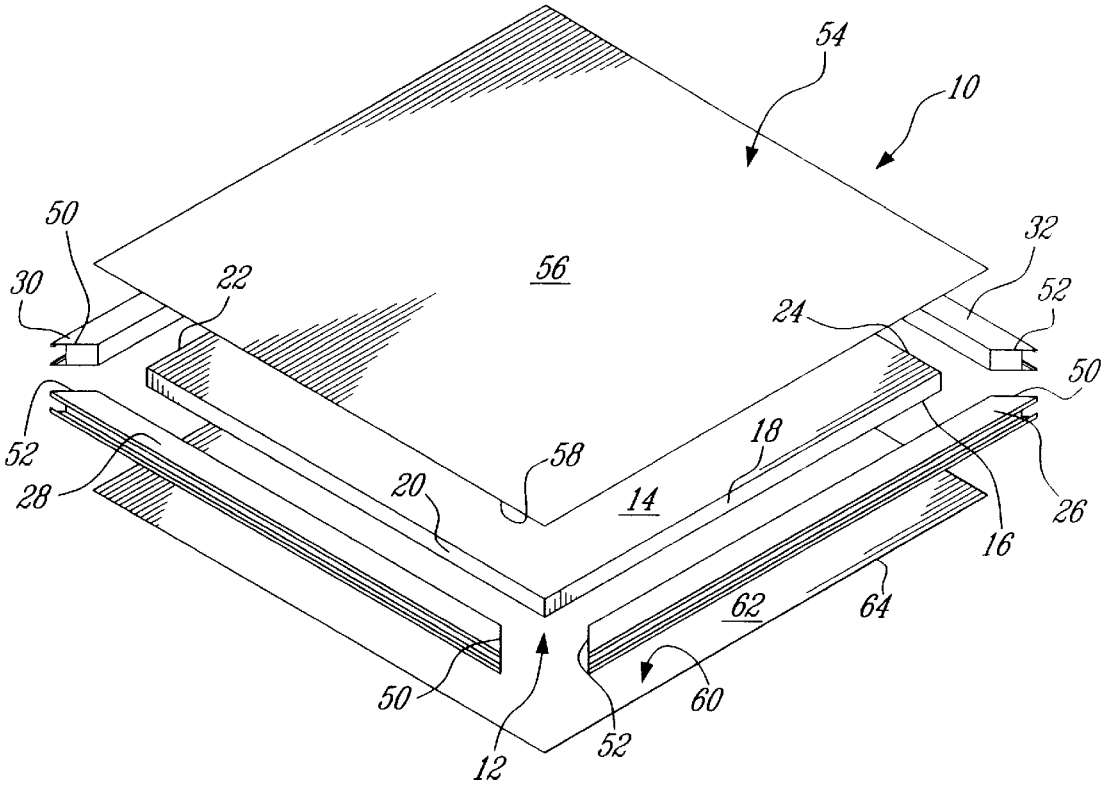
FIG. 1 is an exploded perspective view of a panel of a portable graphic floor system in accordance with the present invention.

According to the drawings and more particularly to FIG. 1, a panel of a portable graphic floor system of the present invention is generally shown at 10. The panel 10 has a core section 12, defining an upper surface 14, a lower surface 16 and lateral sides 18, 20, 22 and 24.

The panel 10 further comprises frame members 26, 28, 30 and 32 as shown in FIG. 1, and which are identical to one another. Thus, like numerals will refer to like elements.

Figure 2:
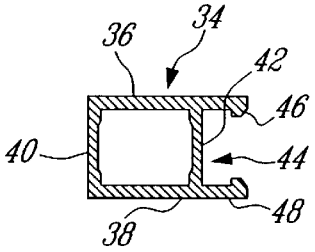
FIG. 2 is a cross-sectional view of a frame member of the panel in accordance with the present invention.

Referring now to FIG. 2, a cross-section of one of the frame members 26, 28, 30 and 32 is shown. Each of the frame members consists of a hollow rod 34 of rectangular cross-section having an upper wall 36, a lower wall 38 and lateral walls 40 and 42. The upper wall 36 and the lower wall 38 outwardly project over lateral wall 42, thereby defining channel 44. Flanges 46 and 48 extend inwardly within the channel 44 from the upper wall 36 and the lower wall 38, respectively.

As shown in FIG. 1, the frame members 26, 28, 30 and 32 further comprise beveled ends 50 and 52. The frame member 26 is integrally bonded, as known in the art, to the lateral side 18 of the core section 12. The thickness of the frame member 26 is such that its upper wall 36 and its lower wall 38 are co-planar with the upper surface 14 and the lower surface 16 of the core section 12, respectively. Furthermore, the length of the lateral wall 40 is substantially equal to the length of the lateral side 18 of the core section 12. This is similar for the frame members 28, 30 and 32, which are integrally bonded to the lateral sides 20, 22 and 24, respectively. A surface defined by beveled end 52 of frame member 26 is co-planar with a surface of the beveled end 50 of the frame member 28. The beveled ends 50 and 52 of the frame members 26, 28, 30 and 32 are similarly co-planar.

The panel 10 also has a laminate layer 54, as shown in FIG. 1. The laminate layer 54 has a graphic surface 56 and an under surface 58. The laminate layer 54 is integrally joined to the core section 12 by the under surface 58 of the laminate layer 54 being bonded to the upper surface 14 of the core section 12, thereby outwardly exposing graphic surface 56. The laminate layer 54 extends over the lateral sides 18, 20, 22 and 24 of the core section 12. Edges of the laminate layer 54 are co-linear with outer edges of the upper walls 36 of the frame members 26, 28, 30 and 32 in such a way that, from a top plan view of the panel 10, the only visible part is the graphic surface 56 of the laminate layer 54. Graphics on graphic surfaces 56 in each panel may form a portion of an overall floor graphic design.

The panel 10 also has a back layer 60 as shown in FIG. 1. The back layer 60 is defined by a top surface 62 and an under surface 64. The back layer 60 is integrally joined to the core section 12 by the top surface 62 being bonded to the lower surface 16 of the core section 12. Similarly to the laminate layer 54, the back layer 60 is dimensioned so that, from a bottom plan view of the panel 10, only the under surface 64 is visible. The back layer balances and reinforces the panels and keeps them straight if they are subject to a lateral pull.

The core section 12 consists of materials such as plywood, perforated plastic or the like. Panels may be provided in various sizes (e.g. 120×120 cm, 120×60 cm, 60×60 cm). Different combinations of panel elements may be assembled according to the needs of a user. Furthermore, the panel elements are replaceable.

Figure 3:
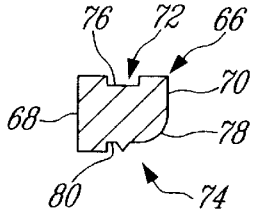
FIG. 3 is a cross-sectional view of a connector in accordance with the present invention.

Referring now to FIG. 3, a cross-section of a connector 66 is shown. The cross-section of the connector 66 defines lateral faces 68 and 70, a top face 72 and a bottom face 74. The top face 72 has a groove 76. A rounded edge 78 is formed adjacent the lateral face 70 and the bottom face 74. The bottom face 74 has a groove 80.

Figure 4:
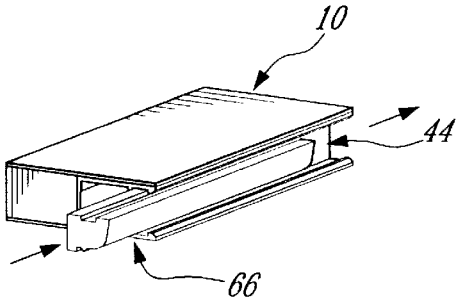
FIG. 4 is a schematic perspective view of the connector being inserted in the panel.
Figure 5:
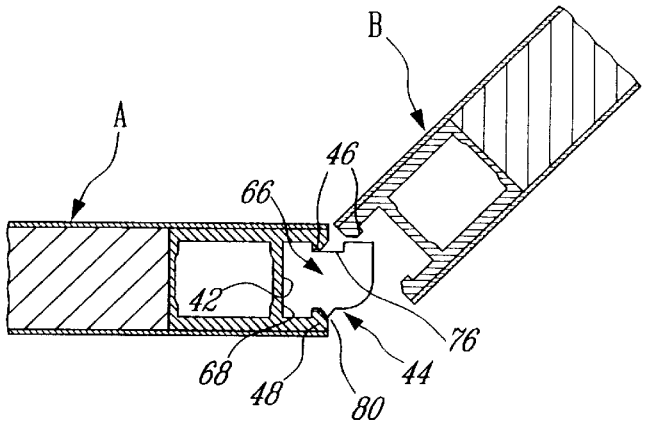
FIG. 5 is a partly sectioned elevational view of a first panel being assembled to a second panel.

Referring now to FIG. 4, the connector 66 is shown being slid in the channel 44 of one of the frame members 26, 28, 30 and 32 of a panel 10. As shown in FIG. 5, the connector 66 is secured in the channel 44 by the flanges 46 and 48 of the channel 44 co-acting with a portion of the groove 76 and the groove 80, respectively. The connector 66 is sized so that lateral face 68 is generally co-planar with lateral face 42 within the channel 44.

Figure 6:
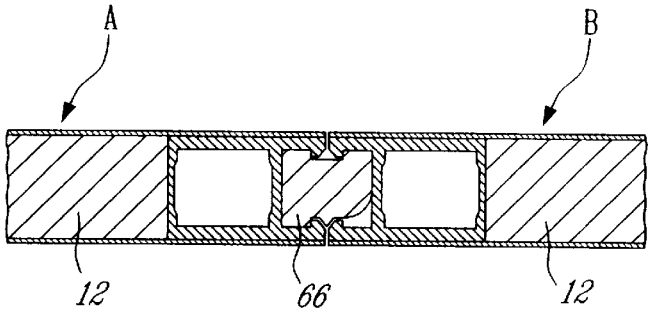
FIG. 6 is a cross-sectional elevational view of the first panel assembled to the second panel.

In order to interconnect a first panel 10 to a second panel 10, respectively referred to as Panel A and Panel B, a connector 66 is inserted in one of the frame members 26, 28, 30 and 32 of Panel A, as described above. As shown in FIG. 5, the flange 46 of tilted Panel B is inserted in a free portion of the groove 76 of the connector 66. The rounded edge 78 of the connector 66 allows for Panel B to be rotated about the groove 76 in a direction downward toward the channel 44 of Panel A and onto a floor surface. When Panel A and Panel B are co-planar, they are interconnected, as shown in FIG. 6. The flanges 46 of Panels A and B co-act with the groove 76 of the connector 66 to prevent the drifting apart of Panels A and B in a direction perpendicular to their co-planar lateral side surfaces.

Figure 7:
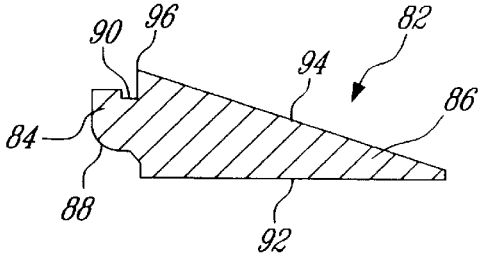
FIG. 7 is a cross-sectional view of a ramp connector in accordance with the present invention.
Figure 8:
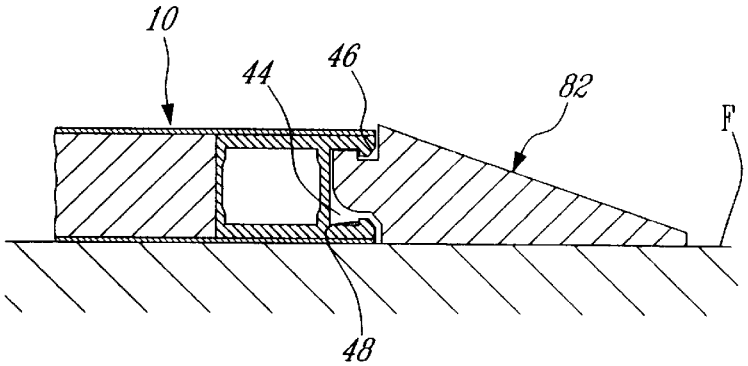
FIG. 8 is a cross-sectional elevational view of the ramp connector mounted to a panel.

Referring now to FIG. 7, a cross-section of a ramp connector 82 is shown. The ramp connector 82 comprises a connecting portion 84 and a ramp portion 86. The connecting portion 84 has a rounded edge 88 and a groove 90. The ramp portion 86 is defined by a bottom surface 92 and a slanted surface 94. A ramp connector 82 is inserted in a channel 44 of a panel 10 by locating the flange 46 of the channel 44 in the groove 90 of the ramp connector 82 and hinging the ramp connector 82 downward until the bottom surface 92 thereof is co-planar with the lower surface 16 of the panel 10, as shown in FIG. 8, at which point the ramp connector 82 is lying on a floor surface F and is interconnected with the panel 10. When the panel 10 and the ramp connector 82 are assembled, an edge 96 of the slanted surface 94 is generally co-linear with an edge of the laminated layer 54 of the panel 10, as shown in FIG. 8.

Figure 9:
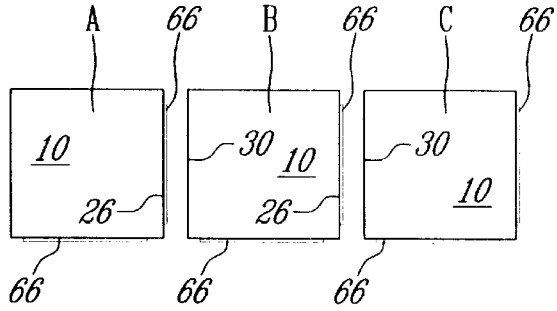
FIG. 9 is a top plan view of panels with connectors disposed for assembly.
Figure 10:
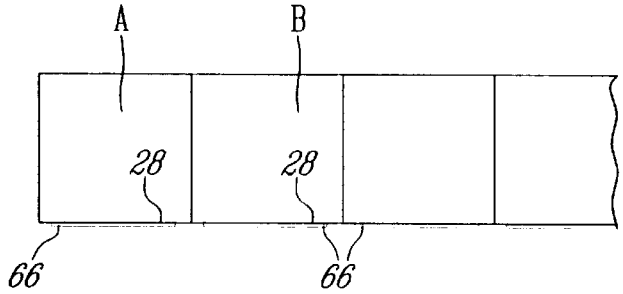
FIG. 10 is a top plan view of panels disposed for assembly to a first row of panels.
Figure 10:
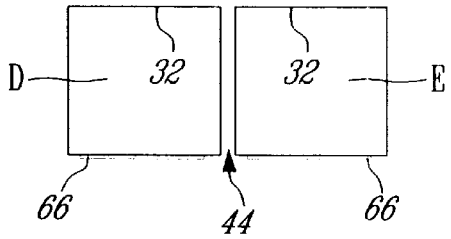

The assembly of the portable graphic floor system according to the present invention is now described by reference to FIG. 9. Connectors 66 are inserted in adjacent frame members of a number of panels 10. The number of panels is predetermined according to the desired dimension of a row. FIG. 9 shows Panel A, Panel B and Panel C, each comprising a pair of adjacent connectors 66. Frame member 26 of Panel A is assembled to frame member 30 of Panel B, following the method depicted in FIG. 5. Similarly, frame member 26 of Panel B is assembled to frame member 30 of Panel C. This is continued until the predetermined number of panels have been assembled to complete the first row. A second row is started by a Panel D being assembled to Panel A. Frame member 32 of Panel D is joined to the connector 66 within the frame member 28 of Panel D, as shown in FIG. 10. Similarly, frame member 28 of Panel B is assembled to frame member 32 of Panel E. Thus, frame member 26 of Panel D and frame member 30 of Panel E are adjacent. A connector 66 (not shown) is slid in the channel 44 of the frame member 26 of Panel D by the method depicted in FIG. 4, thereby integrally joining Panel D to Panel E. The steps are repeated until a second row is fully completed. A predetermined amount of rows are similarly mounted to form a floor surface.

Figure 11:
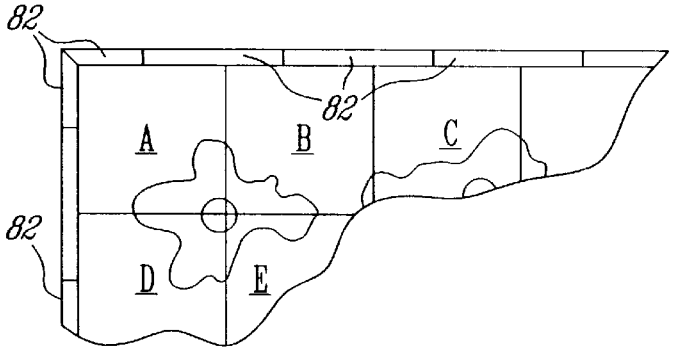
FIG. 11 is a partly sectioned top plan view of ramp connectors mounted to a floor system assembly.

Once the floor surface is formed, ramp connectors 82 are added, according to the aforementioned method. Referring now to FIG. 11, the ramp connectors are positioned to overlap adjacent panels. This prevents the rows and the columns forming the floor surface to be separated in a direction parallel to the connectors 66 joining the panels. The ramp connectors are disposed on the full outer perimeter of the assembled panel floor surface to lock all the panels together. The ramp connectors also provide the portable floor system with wheelchair access.

In consequence of the above described method of assembly, each panel 10 forming the floor surface will be assembled by its four frame members (26, 28, 30 and 32), thereby providing a solid assembly. The portable floor is easy to assemble and no tools nor finishing are required during installation. Furthermore, the installation is rapid (e.g. less than an hour for a 20×20' floor). The various pieces of the portable graphic floor system of the present invention are economical to manufacture. For instance, the frame members may consist of aluminum extrusion. Similarly, the connectors and the ramp connectors may be extruded in materials such as high density polyethylene or the like.

Various processes may be used to bond the laminate and back layers to the core section. For instance, stratifier epoxy may be fused through the layers. The exposed surface of the laminate layer may be provided with graphics, as shown in FIG. 11. As the laminate layer covers the full exposed surface of the panels, the assembly of adjacent panels will be seamless, thereby allowing for a continuation of a image on the exposed surfaces. As an example, high precision digital printing may be combined with a high pressure laminate surface to provide a panel which is resistant to wear, strains, fading and cigarette burns. Another protecting surface may be glued on top of the laminate layer to add further resistance.

It is within the ambit of the present invention to cover any obvious modifications of the preferred embodiment described herein, provided such modifications fall within the scope of the appended claims.

What is claimed is:

1. A method for assembly of a portable floor system on a floor surface to provide a temporary floor of an outer perimeter of predetermined dimension, said method comprising the steps of:

(i) inserting a free end portion of a channel of an inclined second panel to a connecting member releasably secured within a channel of a first panel lying flat on a floor surface;

(ii) downwardly hinging said second panel to an assembled position with said first panel, wherein said first panel and said second panel are connected together, co-planar and in side-by-side relationship;

(iii) slidably inserting an identical one of said connecting member in opposed adjacent channels of a third panel assembled to said first panel and a fourth panel assembled to said second panel, thereby assembling said third panel to said fourth panel;

(iv) continuing assembling further panels according to steps (i), (ii), and (iii) until said floor of predetermined dimension is complete;

(v) inserting a connecting portion of an inclined end connecting member to said free ends of at least two of said channels to overlap at least two of said panels defining said outer perimeter;

(vi) downwardly hinging said end connecting member to an assembled position with said at least two of said panels;

(vii) continuing assembling further end connecting members according to steps (v) and (vi) to immovably interlock all of said panels together.

* * * * *